United States Patent [19]

Seem

[11] 4,244,151

[45] Jan. 13, 1981

[54] ROOF CONSTRUCTION

[75] Inventor: Charles T. Seem, Allentown, Pa.

[73] Assignee: S.M.N. Corporation, Allentown, Pa.

[21] Appl. No.: 31,228

[22] Filed: Apr. 18, 1979

[51] Int. Cl.[3] ..... E04D 1/28; E04D 3/35

[52] U.S. Cl. ..... 52/60; 52/309.9; 52/403; 52/404; 52/595

[58] Field of Search ..... 52/58, 592–595, 52/403, 404, 309.9, 520, 556

[56] References Cited

U.S. PATENT DOCUMENTS

| | | | |
|---|---|---|---|
| 3,397,496 | 8/1968 | Sohns | 52/595 X |
| 3,438,168 | 4/1969 | Tischuk | 52/520 X |
| 3,535,844 | 10/1970 | Glaros | 52/595 |
| 3,849,959 | 11/1974 | Lindner | 52/595 X |
| 3,862,531 | 1/1975 | Attaway et al. | 52/58 X |
| 3,925,952 | 12/1975 | Hagel et al. | 52/58 X |
| 3,998,024 | 12/1976 | Frandsen | 52/595 |
| 4,065,902 | 1/1978 | Lindal | 52/556 |
| 4,100,710 | 7/1978 | Kowallik | 52/595 |
| 4,107,892 | 8/1978 | Bellem | 52/595 X |
| 4,122,641 | 10/1978 | Bard et al. | 52/595 X |

*Primary Examiner*—J. Karl Bell

*Attorney, Agent, or Firm*—Cullen, Sloman, Cantor, Grauer, Scott, & Rutherford

[57] ABSTRACT

A roof construction for use upon a deck or pre-existing roof which includes a series of elongated coplanar roof panels assembled edge-to-edge at their ends in a line and top-to-bottom at right angles thereto juxtaposed over said roof or deck. Each roof panel comprises a thin metallic skin having a rectangular top plate with a downturned front edge along its length. Below the front edge is an assembly slot bounded by an outturned anchor plate adapted for securing to said roof. A series of snap lock stops are formed in said panel and extend into said assembly slot. The top plate has a downturned rear edge which terminates in a flexible outturned assembly plate spaced from and projecting rearwardly of the top plate. The assembly plate terminates in a reverse-turned snap lock flange which extends above said assembly plate. An elongated body of foam plastic material underlies the top plate, the assembly plate and is anchored within the panel with its bottom surface extending to the anchor plate adapted to cooperatively engage the deck or roof. The assembly plate and underlying portion of said body defines a tongue which is snugly nested within the corresponding assembly slot of an adjacent panel, with the lock flange of the one panel snapping into interlocking retaining engagement with the snap lock stops of the adjacent panel.

15 Claims, 10 Drawing Figures

FIG. 1
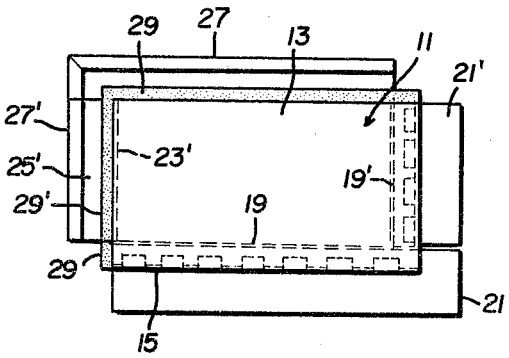
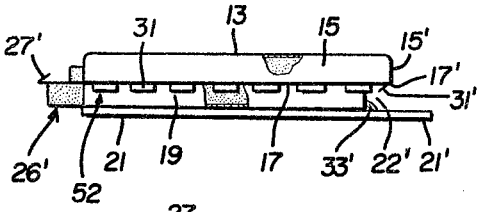
FIG. 2
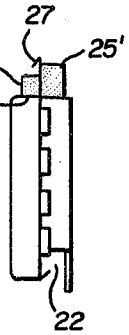
FIG. 3
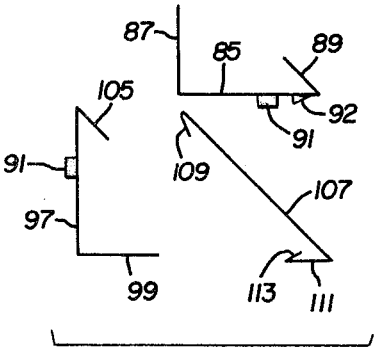
FIG. 9
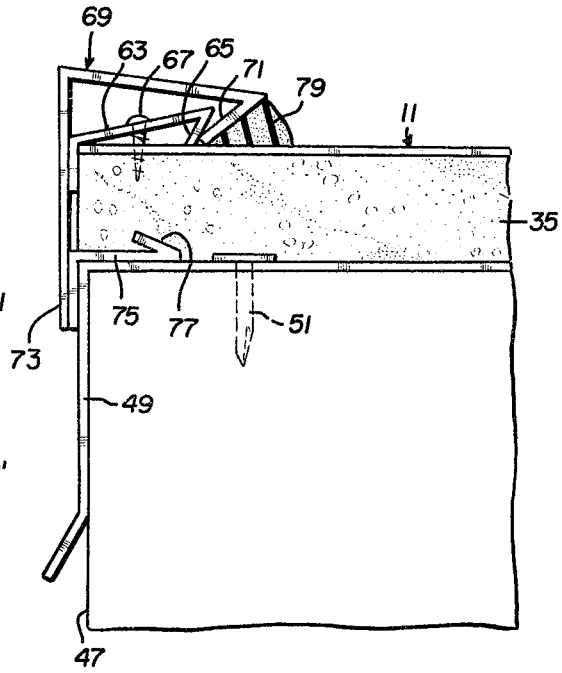
FIG. 10
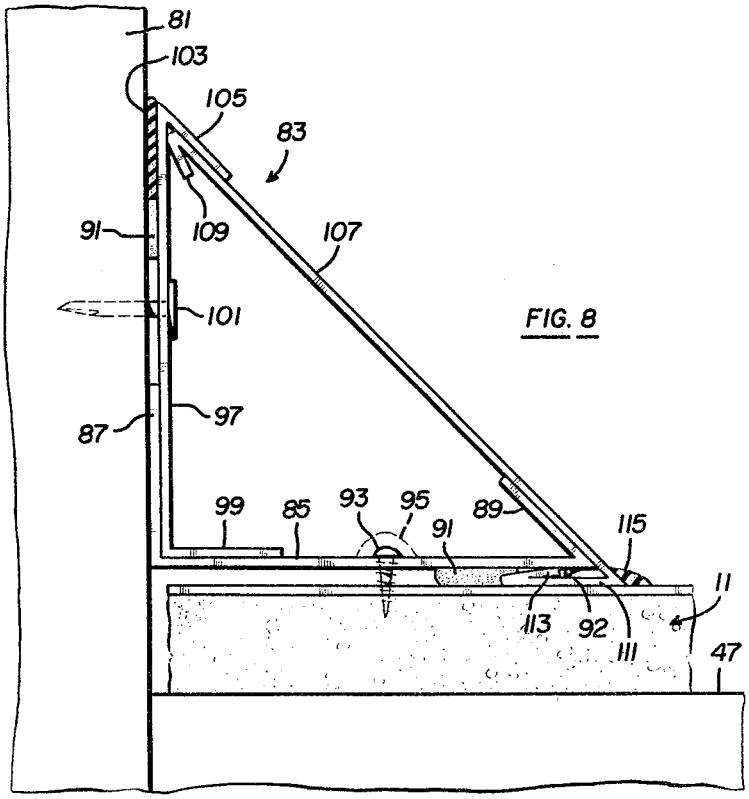
FIG. 8

FIG. 4
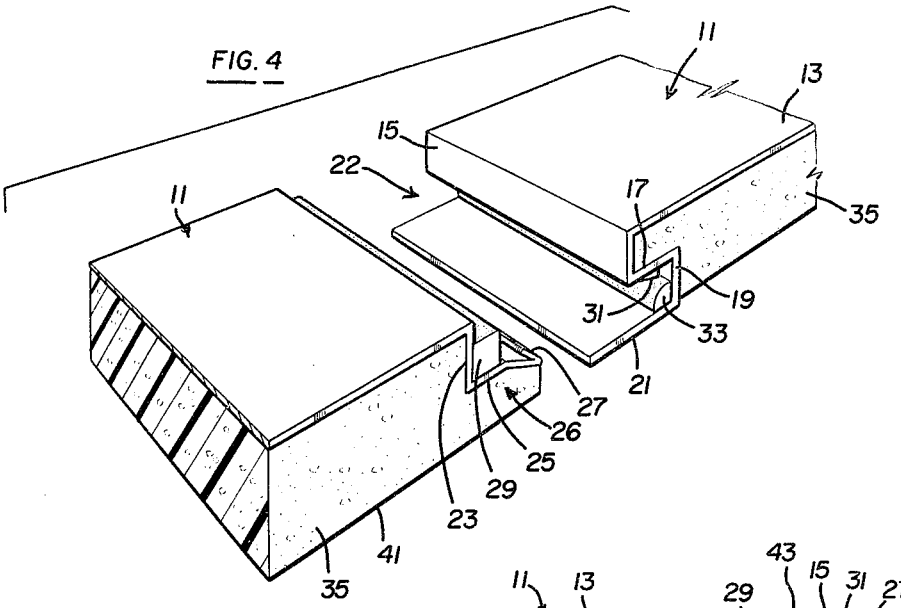
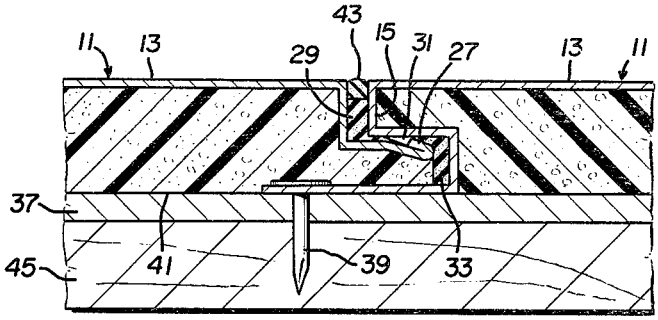
FIG. 5
FIG. 7
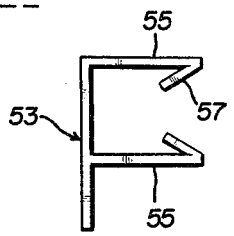
FIG. 6
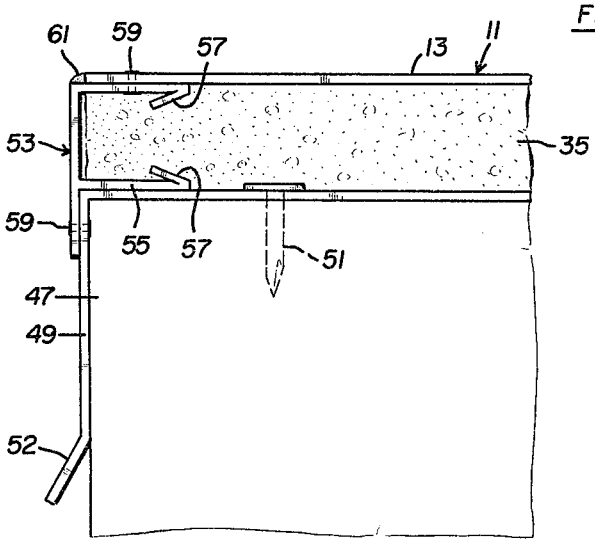

ROOF CONSTRUCTION

BACKGROUND OF THE INVENTION

Heretofore, for the covering of any roof, be it a pre-existing roof or a new roof, flat or steep, such roof has heretofore been covered by shingles, tar, asphalt, gravel, tin, corrugated, pitch, concrete, or plywood. These conventional types of coverings for old or new roofs or decks are bulky and heavy. In the case of asphalt shingles, for example, these may weigh 235-300 pounds per 100 square feet, are difficult and costly to assemble and maintain and after a period of years, have been known to develop moisture leaks and permit the escape of heat. Conventional roofs attract excessive heat, dry out, expand and contract violently, and are always pulling apart and cracking and, thus, require constant maintenance.

Heretofore, in roof constructions, one of the most important factors overlooked is roof insulation.

Illustrative of prior art patents showing roof contructions and the like, including roof panels, are the following U.S. Pat. Nos.:

| | |
|---|---|
| 3,093,935 | 370,317 |
| 2,128,976 | 3,397,496 |
| 358,595 | 3,485,004 |
| 3,042,157 | 3,468,086 |
| 2,913,776 | 2,899,716 |
| 2,717,664 | 1,913,290 |
| 2,277,892 | 2,760,259 |

SUMMARY OF THE INVENTION

It is an object of the present invention to provide an improved roof construction which incorporates a series of assembled roof panels arranged in rows edge-to-edge and wherein, the individual roof panels are of an insulated construction and of light weight.

As an improvement over conventional roofing, the present panels weight approximately 40 pounds per 100 square feet. The present roof panels may be applied to an existing building deck or pre-existing roof and are assembled and interlocked in such a manner as to be fully effective against all types of bad weather including drastic changes in temperature and are maintenance free.

It is a further object to provide a roof panel which is heatinsulating for keeping the heat in wintertime and keeping the heat out in summertime; and will resist the forces of heat and cold, high winds, snow and rain. The present roof panel requires no coating or patching and will never dry out or become brittle or rot or wear out.

It is a further object to provide a roof panel which has built therein expansion joints to resist drastic changes in temperature and to provide for an automatic self-spacing and water-type and air-tight seal between the respective panels.

It is a further object to provide an improved roof panel which consists of a thin metallic skin of aluminum or the like having a rectangular top plate with a downturned front edge and therebelow, a transverse assembly slot bounded by an outwardly extending anchor plate adapted for securing to a deck or a pre-existing roof. A series of aligned struck-out snap lock stops are formed within the panel and extend into the assembly slot. The panel includes a rear edge which terminates in a flexible outturned assembly plate with a reverseturned snap lock angle flange on the edge thereof.

Underlying the top plate is an elongated insulating body of foam plastic material which is secured to the plate with its bottom surface coplanar with the anchor plate to cooperatively engage a deck or a pre-existing roof. The assembly plate and an underlying portion of the foam plastic body defines a tongue adapted for snug nesting within the corresponding assembly slot of an adjacent panel. The lock flange of one panel snaps into interlocked retaining engagement with the snap lock stops of an adjacent panel.

These and other objects will be seen from the following specification and Claims in conjuntion with the appended drawings.

THE DRAWINGS

FIG. 1 is a plan view of a roof panel.

FIG. 2 is a front elevational view thereof.

FIG. 3 is a right side elevational view thereof.

FIG. 4 is a bracketed exploded view fragmentarily illustrating a pair of spaced apart roof panels before assembly.

FIG. 5 is a longitudinal section corresponding to FIG. 4 with the panels assembled together in sealed interlocked relationship.

FIG. 6 is a fragmentary side view of a roof panel overlying a standard drip edge for the roof and a closure strip therefore.

FIG. 7 is an end elevational view of the closure strip.

FIG. 8 is a fragmentary side elevational view of the roof panel shown fragmentarily as bearing against a corresponding wall with a weatherproof flashing interposed therebetween.

FIG. 9 is a bracketed schematic view of the respective parts of the flashing disassembled.

FIG. 10 is a view similar to FIG. 6 showing a different form of roof edge closure strip.

It will be understood that the above drawings illustrate merely a preferred embodiment of the invention, and that other embodiments are contemplated within the scope of the Claims hereafter set forth.

DETAILED DESCRIPTION OF THE INVENTION

The present roof construction is adapted for use upon a deck or pre-existing roof and includes a series of elongated coplanar roof panels assembled edge-to-edge at their ends in a line and top-to-bottom in a line at right angles thereto and juxtaposed over such deck or pre-existing roof. Each roof panel is generally designated at 11, FIG. 1, and comprises a thin metallic skin, preferably aluminum, having a rectangular top plate 13. Along one side of the top plate is a downturned front edge 15, FIGS. 2 and 4, extending along the length of the panel. Said front edge terminates in a return plate 17, which terminates in a downturned upright wall 19, in turn terminating in an outturned anchor plate 21. Said anchor plate is spaced from and projects forwardly of top plate 13 and defines with return plate 17 an assembly slot 22 along one side of said panel.

A series of aligned struck-out snap lock stops 31 are formed in said return plate and extend into the assembly slot, as shown in FIGS. 4 and 5.

The panel includes a downturned rear edge 23 along the opposite edge of said top plate and terminating in a flexible outturned assembly plate 25 which is spaced from and projects rearwardly of top plate 13.

A reverse-turned snap lock angle flange 27 is formed along the edge of and extends above said assembly plate, FIG. 4, and is adapted for interlocking retaining registry with said snap lock stops 31 when a pair of adjacent panels are assembled together, as in FIG. 5.

A strip of sealant foam plastic tape 29 is mounted and secured upon assembly plate 25 at wall 23. The tape may be of polyurethane or a styrofoam.

A flexible transverse sealing bead 33, of a silicone material is nested within the assembly slot 22, is mounted upon anchor plate 21 and bears against the upright plate 19, FIG. 4.

In the unassembled relationship of a pair of panels, FIG. 4, the outer surface of the sealant bead is arcuate. However, upon assembly of the respective panels, FIG. 5, the sealant bead is compressed flexibly to the form shown and sealingly engages portions of the adjacent panel. Likewise, the sealant foam tape 29 is compressed against front edge 15 of the adjacent panel.

An elongated body 35 of a foam plastic material of rectangular cross section underlies top plate 13, underlies the assembly plate 25, FIGS. 4 and 5, and an edge thereof projects interlocking within assembly slot 22 and is suitably retained therein. The undersurface 41 of the foam plastic body, FIG. 5, extends to and is coplanar with anchor plate 21 and is adapted for cooperative sealing engagement with the deck or pre-existing roof 37, having supports 45.

While there is shown in FIGS. 4 and 5, for illustration, the sealing interlock between the tongue 26 along one edge of a panel into the adjacent assembly slot 22 of the next adjacent panel, the present panel also has provision for a similar interlock between the respective end edges of the panel as assembled in a horizontal line. Upon one side edge of the panel, such as shown in FIGS. 1, 2, and 3, there is also provided an assembly slot 22' corresponding to the assembly slot 22, FIG. 4. Upon the opposite end of the panel, there is also formed a corresponding tongue 26' which corresponds to the tongue 26 defined in FIG. 4 as including the assembly plate 25' and the underlying portion of the plastic foam body 35.

Accordingly, upon assembly of the complete roof, the end tongue 26' of one roof panel is adapted for interlock in sealing asssembly within the corresponding adjacent assembly slot 22' along the end of the next adjacent roof panel.

The parts defining the corresponding assembly slot 22' and the corresponding tongue 26' are shown by primed numerals in the drawings, FIGS. 1, 2 and 3, as follows and a detailed description is omitted.

Accordingly the top plate 13 at one end terminates in a downturned edge 15' . This edge terminates in the return 17' , the upright 19' and the outturned anchor plate 21' which projects beyond the end of top plate 13. A corresponding assembly slot 22' is defined between the return 17' and anchor plate 21'.

At the opposite end of the panel at the end of the top plate 13, there is additional upright 23' and this terminates in an outturned assembly plate 25'.

There is struck out from the undersurface of return plate 17' a series of aligned snap lock stops 31', the same as the stops 31, FIG. 5, adapted to interlockingly receive upon assembly the corresponding assembly plate 25' and lock flange 27' projecting from the end of the adjacent roof panel.

Referring again to FIGS. 4 and 5, there is applied to the top of assembly plate 25, and against the upright 23 of the roof panel an elongated sealant foam tape 29 of a suitable plastic material. This is shown as square in cross section in the unassembled view, FIG. 4, but is compressed to a rectangular shape upon assembly of the two panels together, FIG. 5. The sealant foam tape 29 is yieldably and compressively interposed between the adjacent corresponding edges 15 and 23 of adjacent panels.

Similarly, as shown in FIG. 2, there is a sealant bead 33' within the assembly slot 22' and is mounted upon the anchor plate 21' and adapted for corresponding compressive and sealing registry with respect to the tongue and lock flange 27' at the end of an adjacent panel. Likewise, corresponding to the sealant foam tape 29 of FIGS. 4 and 5, there is also arranged upon the corresponding assembly plate 25' the corresponding sealant foam tape 29' of a suitable foam plastic material to thus complete the seal between interlocked end portions of adjacent panels in the same manner as above described with respect to FIGS. 4 and 5.

If desired, the corresponding anchor plates 21' may be additionally secured to the supporting deck or old roof by a series of fasteners similar to fasteners 39, for further anchoring the roof panel. In some situations, this further anchoring can be omitted in view of the series of fasteners 39 for securing the corresponding anchor plate 21 along the longitudinal edge of the respective roof panel.

After assembly of the respective roof panels 11 together in the manner shown in FIG. 5 as well as between the corresponding interlocked end portions of the respective roof panels, there is applied a sealant bead 43. This sealant bead of a suitable silicone material is nested down between the adjacent panels between the walls 23 and 15 and bears upon the corresponding sealant foam tape 29 to thus complete the seal between the longitudinal edges of adjacent roof panels. There would be a similar sealant bead interposed between the corresponding top end edges of the adjacent roof panels arranged end-to-end in the same manner as shown in FIG. 5.

Employed with the present roof panel system, namely, the series of interlocked roof panels 11, there is shown in FIG. 6 upon and around the roof perimeter 47, fragmentarily shown, a continuous drip flange 49 of right angular shape which overlies the perimeter edge of the roof and is suitably secured thereto by fasteners 51. The lower portion of the drip flange 49 is outturned at 52.

As shown in FIGS. 4 and 5, the assembly plate 25 and the underlying portion of the foam plastic body 35 along one edge of the panel define a tongue 26 adapted for snug nesting within the corresponding assembly slot 22 of the adjacent panel thereabove. With this assembly, the lock flange 27 on the flexible assembly plate is interlocked in retaining engagement with the snap lock stops 31 within assembly slot 22, FIG. 5.

The standard drip edge 49 is secured around the perimeter of the roof before applying the roof panels. The panels are scribed and cut off even with the edge of the drip edge 49. Portions of the foam plastic body of the panel are cut back with a standard utility knife along the top thereof under the aluminum top plate 13 to permit insertion of the roll-formed closure strip 53.

Said closure strip has a pair of spaced elongated arms 55 which, at their inner ends terminate in the opposed barbs 57. Arms 55 are projected into the open end of the adjacent roof panels at the edges thereof, there being a series of such roof panels edge-to-edge with the barbs 57 retainingly embedded within the plastic foam body 35.

Before assembly of one panel with respect to the panel therebelow, a series of headed nails 39 or other fasteners secure the anchor plate 21 of one roof panel to underlying portions of the deck or roof.

Pop rivets 59 may be employed if desired for further anchoring the roll form closure strip 53 along the corresponding cut off edges of the adjacent interlocked roof panels. The assembly is completed by the application of an elongated sealant bead 61 over the top edge of the closure strip 53 and which sealingly engages the corresponding outer top edge of the adjacent roof panel top plates 13. One advantage of the construction shown in FIG. 6 is that there are no exposed fasteners.

A modified closure is shown in FIG. 10 corresponding to FIG. 6 and wherein, here also upon and along and around the top perimeter of the roof, 47 there is applied the drip edge 49 of right angular shape suitably anchored to the roof by fasteners 51. Such drip edge is nailed around the perimeter of the roof before application of the panels 11. The panels are cut off even with the edge of the roof or drip edge 49 and are suitably secured to the deck in the manner above described.

Elongated clips 63 overly the top cut off edges of the adjacent roof panels 11 and are secured thereto by fasteners 67. The clips 63 are inclined upwardly relatively to the respective panels and terminate in the reverse-turned anchor flange 65 spanning a series of adjacent panels.

A roll formed closure strip 69, FIG. 10, has along one longitudinal edge the reverse-turned anchor plate 71 and at its opposite end, the end plate 73 which spans the open edges of the respective panels 11 arranged in a line at the roof perimeter and extends down over portions of the drip edge. End plate 73 includes inwardly directed arm 75 having a reverse-turned barb 77 on the inner end thereof.

The closure strip 69 is snapped over clip 63 so that the barb 77 retainingly penetrates a portion of the foam body 35, FIG. 10, with the upper reverse-turned anchor plate 71 interlocked under anchor flange 65.

The assembly is completed by the application of an elongated sealant bead 79 of a suitable silicone material, FIG. 10, which is pressed beneath the anchor plate 71 and sealingly engages adjacent portions of the roof panels 11. Here also, all fasteners are concealed.

In FIGS. 8 and 9, there is shown adjacent the roof perimeter or pre-existing roof or deck 47, an upright wall 81 and a flashing assembly 83 therebetween to provide a moisture-proof seal between the adjacent wall and the adjacent assembled roof panels.

The flashing consists of an elongated base clip plate 85 having a right angular end 87 which loosely bears against the wall 81. The opposite end of the base plate clip includes an elongated reverse-turned first corner angle 89 which extends at approximately 45' degrees thereto.

Applied to the base clip plate is a strip of foam sealant tape 91 of a silicone material which depends from the undersurface of plate 85 and is adapted for compressive sealing engagement with the top surface of the roof panels 11.

Elongated snap latch 92 is formed to extend below plate 85 adjacent the first corner angle 89. The elongated base plate clip 85 is secured to the adjacent roof panels by a series of fasteners 93 individually covered by a suitable sealant material as at 95.

The flashing assembly also includes as shown in FIGS. 8 and 9, an elongated upright clip plate 97 whose right-angular base 99 bears upon the plate 85. Clip 97 bears against the right-angular end 87 of plate 85 and bears against wall 81 and is secured thereto by a series of longitundinally spaced fasteners 101.

There is a corresponding transverse elongated flexible sealant strip 91 of a suitable silicone material on the back of plate 87 adapted for cooperative sealing engagement with wall 81. The upper end of upright plate 97 terminates in a reverse-turned second corner angle 105 or drip edge which extends at an acute angle with respect to the plate 97 and is spaced from and opposed to first corner angle 89, FIG. 8.

The flashing assembly is completed by the elongated inclined closure plate 107 which, at its top longitudinal edge has a reverse-turned end portion 109 adapted for snug nesting engagement within and below second corner angle 105.

The opposite longitudinal edge of said plate has a reverse-turned corner angle base 111, referred to as a third corner angle which extends at an acute angle of approximately 45' degrees with respect to plate 107. The third corner angle is adapted to snugly project under the first corner angle 89 in cooperative engagement therewith and terminates in a reverse-turned elongated barb 113. Said barb is adapted to snap over the respective stop 92 in interlocking relationship and for fixedly securing the closure 107 under compression with respect to the first corner angle 89 and the second corner angle 105.

An elongated sealant strip 103 of a suitable silicone material is applied to the space between wall 81 and the upper end of clip plate 97 for effecting a water-tight seal therebetween.

An additional sealant strip 115 of a suitable silicone material is applied upon and along a third corner angle 111 and overlies and sealingly engages adjacent portions of the assembled roof panels 11 to complete the flashing assembly.

When the first base plate clip 85 is assembled, it is shoved snugly against the wall 81 and secured fast to the respective panels by fasteners 93 to close the gap between the panel and the wall. The upright elongated clip plate 97 fits snugly into the corner of the plate 85 and is fastened vertically to the wall surface at 101 pressing the foam sealant tape 91 against the wall to fill in irregular surfaces thereof so as to form a back up for the job applied liquid sealant strip 103.

The top closure part 107 is inserted under the drip edge 105 at the top of the plate 97. The bottom continous barb section 113 is shoved under the first corner angle 89 to engage and lock into snap latch 92 to thereby form a water-tight flashing at the juncture of the roof panels and said end wall.

The value of this wall flashing system is that it is compatible with and easily fastened to the aluminum-skinned roofing panels and most importantly, is full-floating and separates the roof from the wall allowing completely independent movement so as not to be effected by expansion and contraction factors. This is an extremely valuable necessity in proper roofing procedure and is very often ignored. It is noted that there are no exposed fasteners thus eliminating another source of roof failure.

The closure plate 107 will be slightly elongated in height so as to form a slightly convex shape when in place for more strength and for a snug fit. Similarly, the closure strip 107 would be of greater height when flashing pitched roofs.

With respect to the above defined foam plastic body forming a part of the panel and nested below the top plate thereof, this may be constructed of a suitable polystyrene or Styrafoam as an insulating core material for the panel. Other suitable and equivalent foam plastic materials of the closed-cell type may be employed.

The present assembly including the tongue and groove arrangement with the snap interlock and the associated sealing strips 29 and 33 provides for automatic self-spacing between the respective roof panels and in the assembly thereof and in completing the roof construction.

Having described my invention, reference should now be had to the following claims:

I claim:

1. In a roof construction for use upon a deck or preexisting roof, a series of elongated coplaner roof panels assembled edge-to-edge at their ends in a line, and top-to-bottom in a line at right angles thereto, juxtaposed over said deck or roof;

each roof panel comprising a thin metallic skin having a rectangular top plate;

a downturned front edge along its length;

said front edge terminating in a return plate, which terminates in a downturned upright wall, in turn, terminating in an outturned anchor plate spaced from and projecting forwardly of said top plate; and defining with said return plate an assembly slot;

a series of aligned struckout snap lock stops formed in said return plate and extending into said assembly slot;

a downturned rear edge along the opposite edge of said top plate;

said rear edge terminating in a flexible outturned assembly plate spaced from and projecting rearwardly of said top plate;

a reverse-turned snap lock angle flange at the edge of and extending above said assembly plate;

an elongated body of foam plastic material underlying said top plate, said assembly plate and projected into portions of said panel between said top plate and return plate and anchored therein; its bottom surface extending to said anchor plate and coplanar therewith and adapted to cooperatively engage said deck or roof;

and a series of fasteners securing said anchor plate to said deck or roof;

the assembly plate and underlying portion of said foam plastic body along one edge of a panel defining a tongue snugly nested within the corresponding assembly slot along the opposite edge of an adjacent panel with said lock flange of one panel snapping into interlocked retaining engagement with snap lock stops of said adjacent panel.

2. In the roof construction of claim 1, said metallic skin being aluminum.

3. In the roof construction of claim 1, a flexible sealant bead mounted on said anchor plate within said assembly slot and compressively engageable with said tongue and said snap lock angle flange.

4. In the roof construction of claim 1, a flexible sealant foam tape mounted on and secured to said assembly plate at said rear edge and compressively and sealingly engageable with the downturned front edge of said adjacent panel.

5. In the roof construction of claim 3, a flexible sealant foam tape mounted on and secured to said assembly plate at said rear edge and compressively and sealingly engageable with the downturned front edge of said adjacent panel.

6. In the roof construction of claim 5, a flexible sealant bead interposed between the downturned rear edge of one panel and the downturned front edge of said adjacent panel bearing upon said sealant foam tape and closing the gap between the top plates of adjacent panels.

7. In the roof construction of claim 1, each of said roof panels having an undercut assembly slot at one end; and a projecting tongue at its opposite end, said latter assembly slot and tongue being of the same construction as herein defined with respect to the first mentioned assembly slot and tongue of each panel with the tongue at the end of one panel snugly and sealingly projected into the assembly slot on the end of the adjacent panel, and with the corresponding snap lock angle flange at the edge of said tongue retainingly interlocked with the corresponding snap lock stops extending into the assembly slot at the end of the adjacent panel.

8. In the roof construction of claim 1, there being a drip edge of right angular shape overlying and secured to and along peripheral portions of said deck or roof, underlying the roof panels assembled thereon;

the ends of the roof panels along the roof periphery being cut away for alignment with said roof periphery;

a roll-formed closure strip covering the exposed edges of said panels and overlying a side portion of the roof periphery and secured thereto;

and a pair of spaced arms on said strip with their free ends having reverse-turned opposed barbs, projected into adjacent panels upon the top and bottom of the foam plastic body and retainingly embedded therein.

9. In the roof construction of claim 8, a sealant bead applied to the top edge of said closure strip and in sealing engagement with the top of adjacent roof panels.

10. In the roof construction of claim 1, there being a drip edge of right angular shape overlying and secured to and along peripheral portions of said deck or roof, underlying the roof panels assembled thereon;

the ends of the roof panels along the roof periphery being cut away in alignment with said roof periphery;

an elongated clip overlying and secured to the top peripheral edges of the panels along the roof periphery, said clip being inclined upwardly and terminating in a reverse-turned anchor flange bearing upon said panels;

and a roll-formed closure strip covering the exposed edges of said panels, overlying a side portion of the roof periphery;

and a pair of spaced arms on said strip with their free ends having revese-turned opposed barbs; one arm engaging the undersurface of the foam plastic body of each roof panel with its barb retainingly embedded therein;

the other arm being inclined downwardly with its barb projected under and retainingly engaging said clip anchor flange.

11. In the roof construction of claim 10, an elongated bead of sealant material extending into the space between the upper barb and said panels and affixed thereto.

12. In the roof construction of claim 1, a wall along one side of the roof periphery and projecting above said roof panels;

and a weatherproof flashing between said roof panels and wall including a base clip plate or right-angular shape overlying and bearing upon said roof panels and secured thereto;

a portion of said base clip plate bearing against said wall;

the inner end of said base clip plate having a reverse-turned first corner angle;

there being a struck out anchor stop projected from and below said base clip plate adjacent its corner angle;

an upright clip plate of right angular shape overlying said base clip plate and said wall and secured to said wall;

the upper edge of said upright clip plate having reverse-turned second corner angle facing said first corner angle;

and an elongated inclined closure plate, along its upper edge projected into said second corner angle;

there being a reverse-turned third corner angle along the lower edge of said closure plate;

said third corner angle terminating in a reverse-turned locking flange extending under said first corner angle and retainingly interlocked with said anchor stop.

13. In the roof construction of claim 12, a strip of resilient foam sealant tape upon one side of said base clip plate and said upright clip plate in sealing engagement with said roof panels and wall respectively;

whereby any relative movement between said base clip plate and upright clip plate due to changing weather conditions will not effect the seals between said plates and said panels and wall respectively.

14. In the roof constructon of claim 13, a first elongated strip of sealant materials interposed between the upper end of said upright clip plate and wall;

and a second elongated strip of sealant material overlying the lower edge of said closure plate and the adjacent roof panels.

15. In a roof construction for use upon a deck or pre-existing roof, a series of elongated coplanar roof panels assembled edge-to-edge at their ends in a line, and top-to-bottom in a line at right angles thereto, juxtaposed over said roof or deck;

each roof panel comprising a thin metallic skin having a rectangular top plate;

a downturned front edge along its length;

said front edge having an undercut assembly slot terminating in an anchor plate spaced from and projecting outwardly of said top plate;

means securing said anchor plate to said roof or deck;

a series of aligned struck-out snap lock stops in said panel and extending into said assembly slot;

a downturned rear edge along the opposite side of said top plate, terminating in a flexible outturned assembly plate spaced from and projecting outwardly of said top plate;

a reverse-turned snap angle flange at the edge of and extending above said assembly plate;

and an elongated body of foam plastic material underlying said top plate, said assembly plate and projected into portions of said panel between said top plate and said assembly slot and secured thereto;

its bottom surface extending to said anchor plate and coplanar therewith and adapted to cooperatively engage said deck or roof;

the assembly plate and underlying portion of said foam plastic body along one edge of a panel defining a tongue snugly nested within the corresponding assembly slot along the opposite edge of an adjacent panel with the angle flange of one panel snapping into interlocked retaining engagement with snap lock stops of said adjacent panel.

* * * * *